United States Patent [19]

Murakami et al.

[11] Patent Number: 4,947,772

[45] Date of Patent: Aug. 14, 1990

[54] FINISH-UP STITCHING CONTROL IN AN ELECTRONIC SEWING MACHINE

[75] Inventors: Eiji Murakami; Akira Orii, both of Tokyo, Japan

[73] Assignee: Janome Sewing Machine Co. Ltd., Tokyo, Japan

[21] Appl. No.: 266,384

[22] Filed: Nov. 2, 1988

[30] Foreign Application Priority Data

Nov. 6, 1987 [JP] Japan ..... 62-279081

[51] Int. Cl.[5] ..... D05B 69/26; D05B 19/00

[52] U.S. Cl. ..... 112/262.1; 112/275; 112/317; 112/121.11

[58] Field of Search ..... 112/275, 277, 121.11, 112/121.12, 315, 316, 317, 314, 2, 262.1

[56] References Cited

U.S. PATENT DOCUMENTS

| | | | |
|---|---|---|---|
| 3,761,790 | 9/1973 | Daab | 112/275 X |
| 4,137,860 | 2/1979 | Yoneji et al. | 112/275 X |
| 4,548,143 | 10/1985 | Martell et al. | 112/275 X |

*Primary Examiner*—Peter Nerbun

*Attorney, Agent, or Firm*—Michael J. Striker

[57] ABSTRACT

A sewing machine and a method of controlling operation of the same wherein reading out of a selected finish-up stitch pattern is effected substantially simultaneously with generation of rotation speed reduction signal when an actual rotation speed of the machine is lower than the reference rotation speed, and when a rotation speed is reduced to the reference rotation speed upon the actual speed of the machine being higher than the reference rotation speed.

4 Claims, 2 Drawing Sheets

FINISH-UP STITCHING CONTROL IN AN ELECTRONIC SEWING MACHINE

FIELD OF THE INVENTION

The present invention relates to an electronic sewing machine which is capable of stitching various kinds of patterns and finish-up.

BACKGROUND OF THE INVENTION

When stitching patterns stored in the electronic sewing machine on a fabric, an end part of the fabric to be stiched is stepped with several stitchings of finish-up to avoid ravellings of the stitch. The sewing machine is stopped automatically after the finish-up stitchings, irrespective of an amount of operation a machine controller.

There are in general two ways of stopping the sewing machine i.e., a forcible braking by using the braking of electricity, and a natural stopping by only stopping the supply of electricity. We would refer to the latter in view of cost merits.

A position to be stopped is determined with reference to a certain range about an upper dead point of a needle bar, and the finish-up stitching is carried out at low speed, so that the needle bar stops within said range. On the other hand, ordinary patterns are formed by controlling the amount of operation of the controller at optional speed from a low speed to a high speed.

No problem occurs, when the pattern is stitched at the low speed and the finish-up stitching is selected. If the finish-up stitching is selected while the ordinary pattern is being stitched at the high speed, it takes a long time for the rotation speed of the sewing machine to change from the high speed to the low speed. If an inertia of a load of the machine motor is large, the time of changing from the high speed to the low speed is also large. Then, although the finish-up stitching is ended at the determined several steppings, the speed does not become fully low. If trying to stop the needle bar under such a condition, the needle bar stops outside of the range, and as the case may be, the needle bar goes down nearly to the lower dead point and stops as it still penetrates a fabric. This is inconvenient to a machine operator, and the function of the sewing machine is often adversely affected.

As far as the finish-up stitching plays a role of avoiding the ravellings, the lesser stitchings are desirable. However, due to inconveniences as said above, the finish-up stitches are formed with excess stitchings. This is wasteful, and the operator feels nervous about spending much time on this operation.

SUMMARY OF THE INVENTION

In the invention, following measures have been prepared to remove the shortcomings involved with the prior art.

(1) The stitching number for the finish-up is changed in response to the rotation speed of the sewing machine when selecting the finish-up stitching. That is, if the finish-up stitching is selected while the pattern is formed at the low speed, the finish-up is ended at normal stitching number. When the ordinary pattern is stitched at the high speed, the stitching number is increased to an extent that the speed becomes low for the finish-up stitching.

(2) Timing for entering the finish-up stitching is changed in response to a change in the rotation speed of the sewing machine when the finish-up stitching is selected. That is, if the finish-up stitching is selected while the pattern is formed at the high speed, the speed of the finish-up stitching is lowered, but the stitching does not enter instantly the finish-up, and the pattern is stitched with the several steppings, and when the rotation speed is sufficiently low, the finish-up stitching is begun.

By the above measures (1) and (2), influences of the inertia is cancelled, and a desired stopping may be secured. Especially with the measure (1), it is possible to reduce the stitching number of the finish-up.

DETAILED DESCRIPTION OF PREFERRED EMBODIMENTS OF THE INVENTION

Figure 1:
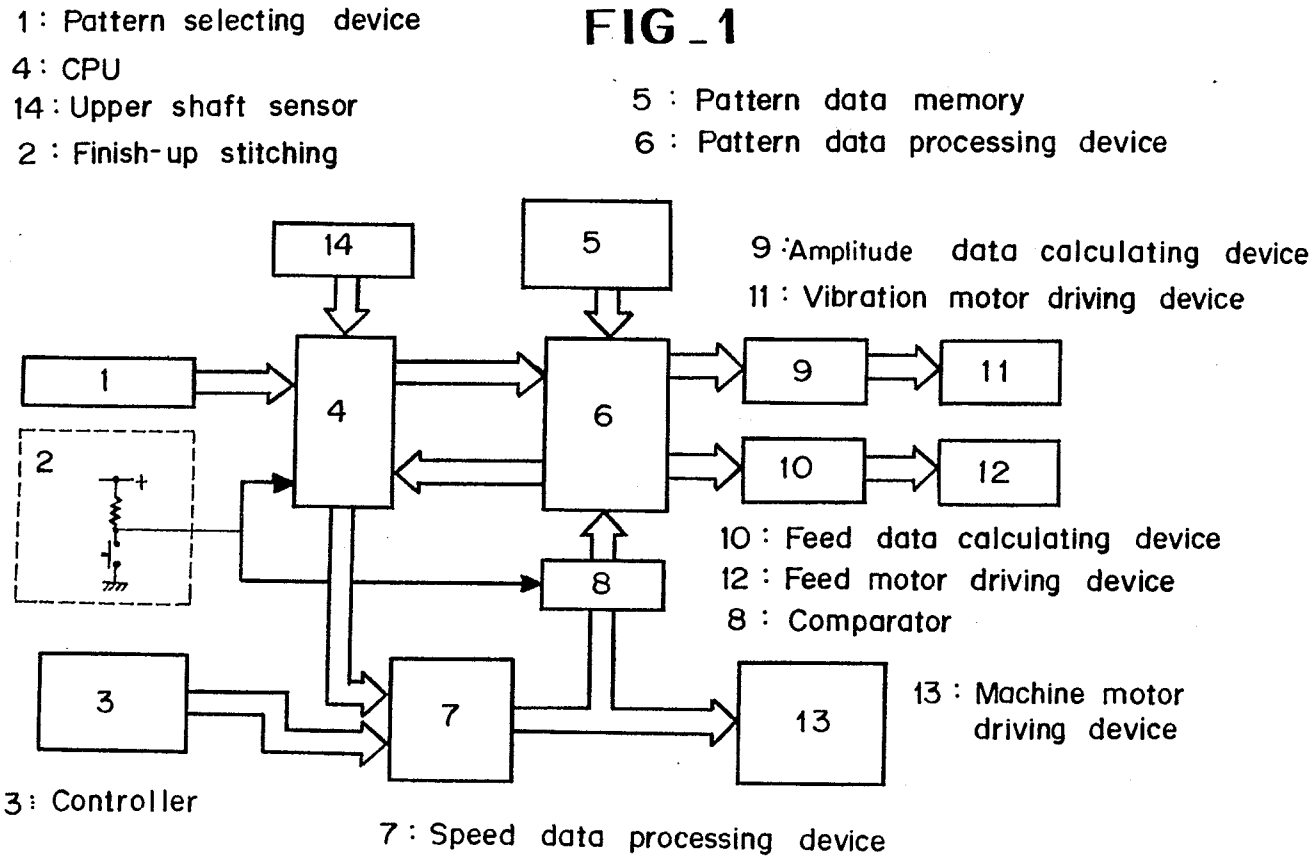
FIG. 1 is a block diagram of controlling an apparatus of the invention.

FIG. 1 shows an embodiment of the invention, and a reference will be made to the structure thereof. The machine includes:

1: A pattern selection device comprising a plurality of key switches for selecting stitching patterns;

2: A finish-up stitching device comprising one key switch for starting the finish-up stitching;

3: A controller comprising one variable resistor which varies the rotation number of the sewing machine within a determined range;

4: A central processing unit which receives information from the pattern selecting device 1 and the finish-up stitching device 2, and issues to a pattern data processing device 6 an order for taking a stitching data of a desired pattern and sending to a speed data processing device 7 orders such as normal actuation, a low speed actuation or a stop;

5: A pattern data memory which stores all pattern stitching data and the finish-up stitching data to be selected by the pattern selecting device 1;

6: A pattern data processing device which receives an order from the central processing unit 4, and takes a stitching pattern data of the desired pattern and processes it as determined and thereafter sends required data to an amplitude data calculating device 9 and a data calculating device 10, and receives a signal from a comparator 8 so as to control the number of stitches prior to the finish-up, and sends an ending signal of the finish-up stitching to the central processing unit 4;

7: A speed data processing device, through an analos-to-digital converter, which converts the amount of operation of the controller 3 for processing it as determined, and sends it to a machine motor drive device 13, and receives an order from the central processing unit 4 and provides speed data such as a low speed actuation or a stop actuation, irrespective of the amount of operation of the controller;

8: A comparator which, when receiving a signal from the finish-up stitching device 2, compares a reference speed data with a speed data to be sent to a machine motor driving device 13 from the speed data processing device 7, and transmits a compared result to a pattern data processing device 6;

9: An amplitude data calculating device which receives an amplitude data from the pattern data processing device 6 and obtains an amount of movement and a direction to thereby control an amplitude motor driving device 11;

10: A feed data calculating device which receives feed data from the pattern data processing device 6 and obtains an amount of movement and a moving direction, to thereby control a feed motor driving device 12;

11: A device for driving an amplitude driving motor;

12: A device for driving a feed motor;

13: A device for driving the sewing machine in response to a signal from the speed data processing device 7, and 14: An upper shaft sensor for outputting a timing signal in synchronism with the rotation of the upper shaft.

Actuations will be explained, referring to FIG. 1.

At first, a pattern is selected with the pattern selecting device 1.

When the controller 3 is operated, the speed data is sent to the machine motor driving device 13 in response to the amount of operation through the speed data processing device 7, so that the machine motor is rotated.

While the machine is running, the central processing unit 4 issues an order to the pattern data processing device 6 in synchonism with the timing when the upper sensor 14 sends a signal. Then, each time of receiving the order, the pattern data processing device 6 takes the stitching data of a selected pattern from the pattern data memory device 5 for one stitch, and processes said stitching data as determined and sends it to the amplitude data calculating device 9 and the feed data calculating device 10. The devices 9 and 10 carry out determined calculations for obtaining the moving amount and the moving direction of a desired motor, by results of which the devices 9 and 10 send signals to the amplitude motor driving device 11 and the feed motor driving device 12. The pattern is thus formed.

If the finish-up stitching device 2 is operated under the above stated condition, the central processing unit 4 sends the order to the pattern data processing device 6 so as to form the finish-up stitching patterns of the determined stitching number by the above mentioned process.

At the same time, the central processing unit 4 sends an order for the low speed to the speed data processing device 7. The device 7 receives this order and decreases the rotation speed by the machine motor driving device 13.

When confirming an end of the finish-up stitching, the pattern data processing device 6 sends the ending signal to the central processing unit 4. The central processing unit issues a stopping order to the speed data processing device 7, and the device 7 receives this order and stops the machine motor driving device 13.

The above statement refers to the finish-up stitching. If the sewing machine runs at the high speed when the finish-up stitching is operated, it takes much time for the speed to go down to a determined low level due to an inertia of the load of the machine motor, even though the central processing unit 4 issues the low speed order. During this time period, although the finish-up stitching is ended by the determined stitching number, and the stopping order is sent to the speed data processing device 7, the sewing machine stops over an objectional range, since the rotation speed of the sewing machine is not yet duly low.

For such a case, following measures are adopted.

On instantaneously operating the finish-up stitching device 2, the comparator compares the speed data VD sent from the device 7 to the machine motor driving device 13 with a reference speed determined in the comparator 8. The comparator 8 sends to the pattern data processing device 6 an information as to whether the speed data VD is higher or lower than a reference level VS. The device 6 controls the number of stitches prior to the finish-up stiching in accordance with this information. If VD is lower than the reference level, the device 6 sends to the central processing unit 4 an ending signal after the finish-up stitching has been made with the ordinary stitching number. On the other hand, if VD is higher than the reference level, the device 6 issues the ending signal after the finish-up stitching has been made with stitching number more than the ordinary stitching number, when the rotation speed of the sewing machine is thus fully low.

Even if the finish-up stitching is carried out at the high speed rotation by such processings, the needle bar may be stopped within the determined range without being influenced by the inertia.

A further reference will be made to a case that when the finish-up stitching is selected at the high speed, the operation is delayed in entering the finish-up stitching by several stitchings.

When the finish-up stitching device 2 is operated, the speed data VD sent from the speed data processing device 7 to the machine motor driving device 13 is compared with the reference speed VS determined in the comparator 8, and the comparator 8 sends a compared result between VD and VS to the pattern data processing device 6. The device 6 controls a timing for entering the finish-up stitching in accordance with this information. In case of $VD<VS$, the pattern data processing device 6 sends a low speed requesting signal to the central processing unit 4, and takes the finish-up pattern data from the pattern data memory device 5, and sends, after a determined processing, necessary data to the amplitude data calculating device 9 and the feed data calculating device 10. On the other hand, in case of $VD>VS$, the pattern data processing device 6 sends the low speed requesting signal to the central processing unit 4, but does not take instantly the finish-up pattern data from the pattern data memory device 5, and takes the present pattern data for a period of several stitchings and subsequently begins to take the finsh-up pattern data. In such a manner, when the operation enters the finish-up actuation, it is possible to secure a desired stopping position after the determined stitching number, since the rotation speed is duly low. In addition, it is not necessary to increase the stitching number of the finish-up more than requested.

The same manner is applicable to a memory stitching where ordinary several patterns are stored and the finish-up stitching is stored, and the present invention may be applied widely.

Figure 2:
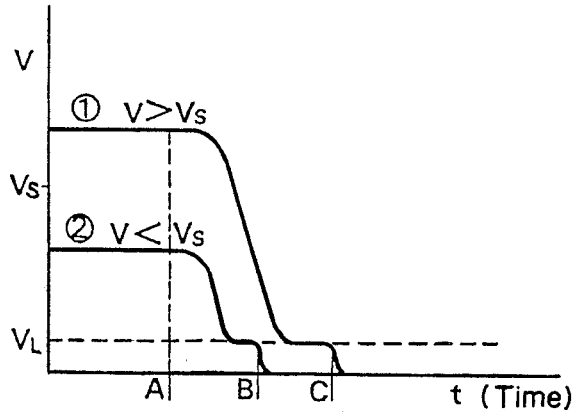
FIG. 2 is a diagram showing relationship between time and the rotation speed of the sewing machine, when the stitching number is changed.

(1) The finish-up stitching, changing the stitching number, is explained with FIG. 2.

V: the rotation speed of the sewing machine

VS: the reference rotation speed

VL: the low speed for finish-up stitching

A: time at selecting the finish-up stitching

B: time at ending the finish-up stiching of ②

C: time at ending the finish-up stitching of ①

In both of ① and ②, the finish-up stitching is started at the point of A.

In the case of ②, that is, when the speed V at the time of selecting the finish-up stitching is lower than the reference speed VS, the rotation speed of the sewing machine is fully lowered to the speed VL for the finish-up stitching, and so the rotation is stopped at B after the finish-up stitches of a predetermined number are finished.

In the case of V>VS of ①, since the rotation speed does not become the low speed VL during the finish-up stitching, the stitching number of the stitches is made more than the predetermined number until the rotation speed is reduced to the low speed VL and stops at C.

Figure 3:
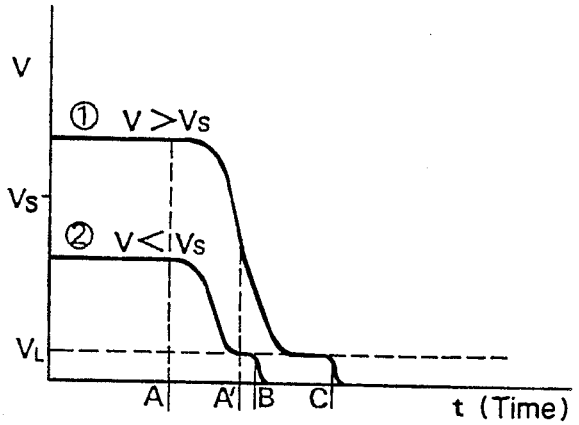
FIG. 3 is a diagram showing relationship between time and the rotation speed of the sewing machine, when the starting time of the finish-up stitching is changed.

(2) The finish-up stitching with changing the starting time, is explained with reference to FIG. 3.

V: the rotation speed of the sewing machine

VS: the reference rotation speed

VL: the low speed for finish-up stitching

A: time at selecting the finish-up stitching (①, ②), starting time of the finish-up stitching of ②

A': starting time of the finish-up stitching of ①

B: time at ending the finish-up stitching of ②

C: time at ending the finish-up stitching of ①

In the case of ② V<VS, since the rotation speed becomes fully low speed (VL) during the finish-up stitching, the stitching enters instantly the finish-up actuation at the finish-up selecting time A, and stops at B after the finish-up stitching of the reference stitching number.

In the case of ① (V>VS), since the rotation speed does not reach the low speed (VL) for the finish-up stitching, the stitching does not enter the finish-up actuation at the finish-up selecting time A, and the low speed signal is only produced, and the finish-up actuation is made when the rotating speed becomes fully low. At this state, since the rotation is fully low during the finish-up stitching, the rotation is stopped at C point where several stitchings are ended.

What is claimed is:

1. A sewing machine comprising a pattern selecting device having a memory for selecting at least one pattern from a plurality of different patterns that includes a pattern of finish-up stitches, stored in said memory; a finish-up stitch selecting switch for selecting a finish-up stitch pattern upon a selected pattern being completely stitched; central control means for generating a machine speed reduction signal in response to actuation of said finish-up stitch selecting switch; means for comparing an actual rotation speed of the machine with a reference rotation speed in response to actuation of said finish-up stitch selecting switch and for generating a first signal upon the actual rotation speed being higher than the reference rotation speed, said central control means reading out the finish-up stitch pattern from said memory in response to the first signal upon a rotation speed of the machine being reduced to the reference rotation speed.

2. The sewing machine as set forth in claim 1, wherein said comparing means generates a second signal upon the actual rotation speed of the machine being lower than the reference rotation speed, said central control means reading out the finish-up stitch pattern from said memory in response to the second signal substantially at a time of generation of the speed reduction signal.

3. A method of controlling operation of a sewing machine comprising the steps of selecting at least one pattern from a plurality of different patterns that includes a pattern of finish-up stitches, stored in a memory of a pattern selecting device; selecting a finish-up stitch pattern upon a selected pattern being completely stitched by actuating a finish-up selecting switch; generating a machine speed reduction signal in response to the actuation of the finish-up stitch selecting switch; comparing an actual rotation speed of the machine with a reference rotation speed in response to actuation of the finish-up stitch selecting switch and generating a first signal upon the actual rotation speed being higher than the reference rotation speed; and reading out the finish-up stitch pattern from the memory of the pattern selecting device in response to the first signal upon the rotation speed of the machine being reduced to the reference rotation speed.

4. A method as set forth in claim 3, comprising the step of generating a second signal upon the actual rotation speed of the machine being lower than the reference rotation speed, the reading out the finish-up stitch pattern from the memory of the pattern selecting device in response to the second signal being effected substantially at a time of generation of the speed reduction signal.

* * * * *